US007180241B2

(12) United States Patent
Ito

(10) Patent No.: US 7,180,241 B2
(45) Date of Patent: Feb. 20, 2007

(54) PLASMA DISPLAY APPARATUS

(75) Inventor: Kazuhiro Ito, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 69 days.

(21) Appl. No.: 11/140,014

(22) Filed: May 26, 2005

(65) Prior Publication Data

US 2005/0264235 A1 Dec. 1, 2005

(30) Foreign Application Priority Data

May 28, 2004 (KR) ..... 10-2004-0038279

(51) Int. Cl.
*H01J 17/00* (2006.01)
*H01J 9/18* (2006.01)

(52) U.S. Cl. ..... 313/581; 445/33; 315/169.4; 345/60

(58) Field of Classification Search ..... 315/167, 315/169.4; 313/581; 445/23, 24, 29, 33, 445/66, 67; 345/60, 67
See application file for complete search history.

(56) References Cited

U.S. PATENT DOCUMENTS 5,745,086 A 4/1998 Weber ..... 345/63
6,407,508 B1 * 6/2002 Kawada et al. ..... 315/169.3
7,059,473 B2 * 6/2006 Watanabe et al. ..... 206/454
2005/0168407 A1 * 8/2005 Lee et al. ..... 345/60
2005/0231442 A1 * 10/2005 Kim et al. ..... 345/60

FOREIGN PATENT DOCUMENTS

JP 2004-29389 1/2004

OTHER PUBLICATIONS

Patent Abstracts of Japan for Publication No. 2004-029389; Date of publication of application Jan. 29, 2004, in the name of Akira Shiokawa et al.

* cited by examiner

*Primary Examiner*—Thuy Vinh Tran
(74) *Attorney, Agent, or Firm*—Christie, Parker & Hale, LLP

(57) ABSTRACT

A plasma display apparatus minimizing the occupying area of the driving boards in the chassis base by using an integrated driving board capable of driving scan electrodes sustain electrodes. A plasma display panel includes: a plurality of first electrodes (sustain electrodes or X electrodes), a plurality of second electrodes (scan electrodes or Y electrodes), a plurality of third electrodes (address electrodes) extending in a direction crossing the plurality of the first and the second electrodes, and a chassis base to which the plasma display panel is fixed. Driving boards are attached on a second side of the chassis base, the driving boards generating a driving voltage and applying the driving voltage to the electrodes. The first electrodes are grounded to the chassis base.

17 Claims, 6 Drawing Sheets

PLASMA DISPLAY APPARATUS

CROSS REFERENCE TO RELATED APPLICATION

This application claims priority to and the benefit of Korean Patent Application No. 10-2004-0038279 filed on May 28, 2004 in the Korean Intellectual Property Office, the entire content of which is incorporated herein by reference.

BACKGROUND OF THE INVENTION

1. Field of the Invention

The present invention relates to a plasma display apparatus that reduces the occupying area of the driving boards on a chassis base thereof.

2. Description of the Related Art

A plasma display panel (PDP) is a display device that uses plasma generated by gas discharge to produce an image thereon and has dozens to hundreds of millions of pixels (discharge cells) arranged in matrix depending on the screen size thereof. The PDP is classified into a direct current (DC) type and an alternating current (AC) type with respect to the waveform of the driving voltage and the structure of the discharge cell.

In the case of the DC PDP, the electrodes are exposed to the discharge space, and the current flows through the discharge space while the voltage is applied. Therefore, the DC PDP has the shortcoming of making a resistance to restrict the current. On the other hand, the AC PDP has a dielectric layer covering the electrodes so that the current is restricted by a capacitance formed naturally and the electrodes are protected from the ion bombardment during the discharge. Therefore, the AC PDP has the advantage of a long life over the DC PDP.

FIG. 1 is a partial perspective view of a plasma display panel. The PDP includes a first substrate 1 and a second substrate 2, the first substrate 1 and the second substrate 2 facing each other. On the first substrate 1, a plurality of paired scan and sustain electrodes 3*a*, 3*b* are formed in parallel with each other. Both the scan electrodes 3*a* and the sustain electrodes 3*b* are covered by a dielectric layer 4 and a protective layer 5 in turn. A plurality of address electrodes 6 are formed on the second substrate 2 and covered by a dielectric layer 7. Barrier ribs 8 are formed on the dielectric layer 7 between the address electrodes 6. Also, phosphors 9 are formed on the dielectric layer 7 and both sidewalls of the barrier ribs 8. The first and the second substrates 1, 2 are positioned and apart from each other by discharge space 11 in such a way that the direction of the scan and sustain electrodes 3*a*, 3*b* cross the direction of the address electrodes 6. Discharge cells 12 are formed in the discharge space 11 at the intersections between the address electrodes 6 and the paired scan electrodes 3*a* and sustain electrodes 3*b*.

In the AC PDP, a single frame is generally divided into and driven by plural subfields, each subfield consisting of a reset period, an address period and a sustain period. The reset period is a period when the state of each discharge cell 12 is initialized to carry out addressing in the discharge cell 12 effectively. The address period is a period when the discharge cell to be turned on is selected from the discharge cells of the PDP and wall charges are accumulated in the selected discharge cell to be tuned on (the discharge cell addressed). The sustain period is a period when discharge occurs in the discharge cell to be tuned on for producing an image.

For these operations, sustain pulses are alternatingly applied to the scan electrode and the sustain electrode during the sustain period, and a reset waveform and a scan waveform are applied to the scan electrode during the reset and the address period, respectively. Therefore, it is necessary to have both a scan driving board for driving the scan electrode and a separate sustain driving board for driving the sustain electrode. Two separate driving boards need a large area for installation on the chassis base, and the cost rises due to two driving boards.

Therefore, it has been proposed that two driving boards be integrated into a single board. The single board would be placed at one end of the scan electrode and connected to the sustain electrode by extending one end of the sustain electrode. However, such an integrated driving board has the disadvantage of large impedance due to very elongated sustain electrodes.

SUMMARY OF THE INVENTION

The present invention provides a plasma display apparatus minimizing the occupying area of the driving boards on the chassis base by using an integrated driving board capable of driving scan electrodes and sustain electrodes.

The plasma display apparatus in accordance with the present invention is composed so as to apply a driving waveform to the scan electrode with a sustain electrode biased to a constant voltage.

The plasma display apparatus in accordance with the present invention includes a chassis base, a plasma display panel fixed to the chassis base, and driving boards attached on the chassis base. The plasma display panel includes a plurality of first electrodes (sustain electrodes or X electrodes), a plurality of second electrodes (scan electrodes or Y electrodes), and a plurality of third electrodes (address electrodes or A electrodes) extending in a direction crossing a plurality of the first and the second electrodes. The driving boards generate a driving voltage and apply the driving voltage to the electrodes. The first electrode is grounded to the chassis base or may be grounded to the chassis base through a flexible printed circuit (FPC).

In an embodiment in accordance with the present invention, a plasma display apparatus includes a chassis base, a plasma display panel fixed to the chassis base, and driving boards attached on the chassis base. The plasma display panel includes a plurality of first electrodes, a plurality of second electrodes, and a plurality of third electrodes extending in the direction crossing a plurality of the first and the second electrodes. Also, the driving boards include an image processing and controlling board receiving image signals from outside and generating controlling signals, and the image signals from outside is composed of a plurality of frames. Moreover, each frame is generally divided into plural subfields, and one subfield at least includes a reset period, an address period and a sustain period. In the reset period, with the first electrode (sustain electrode, X electrode) biased to a first voltage (0 V), a voltage to the second electrode (scan electrode, Y electrode) rises from a second voltage (Vs) to a third voltage (Vset) gradually and then, falls from a fourth voltage (Vs) to a fifth voltage (Vnf) gradually. A discharge cell to be turned on is selected in the address period. In the sustain period, with the first electrode biased to the first voltage (0 V), pulses having a sixth voltage (Vs) and a seventh voltage (−Vs) lower than the sixth voltage alternatingly are applied to the second electrode to make the sustain discharge occur in the selected discharge cell. A voltage applied to the third electrode in a first time period, the first time period being at least a part of the time period when the voltage to the second electrode rises from the second voltage to the third voltage, may be formed higher than an eighth voltage applied to the third electrode during the time period when the voltage to the second electrode falls to the fifth voltage (Vnf).

A voltage difference between the sixth voltage and the first voltage is equal to the voltage difference between the first voltage and the seventh voltage.

The driving boards include an image processing and controlling board, an address buffer board, a scan driving board and a power supplying board. The image processing and controlling board receives image signals from outside and generates controlling signals to drive the third electrode (address electrode, A electrode) and controlling signals to drive the second electrodes (scan electrodes or Y electrodes). The address buffer board receives controlling signals from the image processing and controlling board and applies to the third electrode (address electrode) a voltage to select the discharge cell to be displayed. The scan driving board receives driving signals from the image processing and controlling board and applies the driving voltage to the second electrode (scan electrodes or Y electrodes) The power supplying board supplies power to drive the plasma display panel.

The FPC may be grounded to the chassis base through a ground board grounded to the chassis base.

The FPC may also be grounded directly on the chassis base.

DETAILED DESCRIPTION

Figure 1:
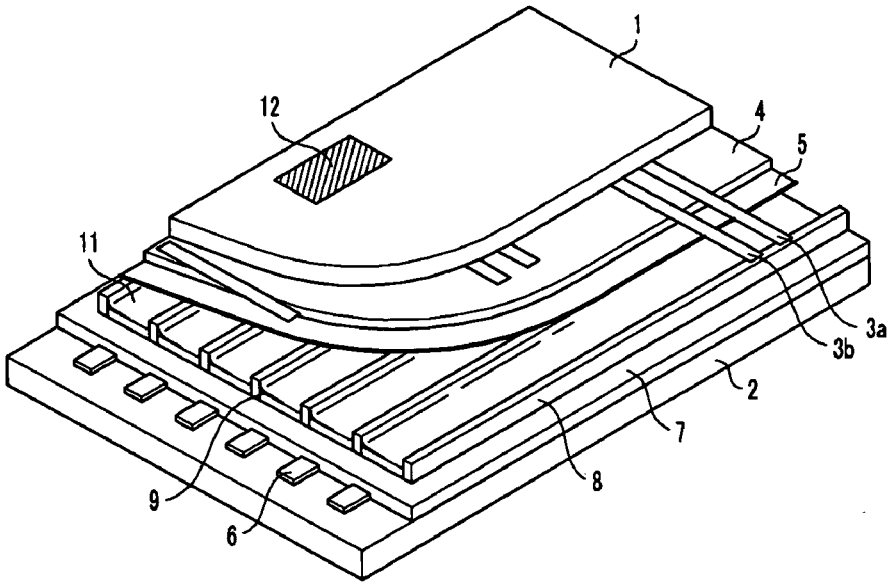
FIG. 1 is a partial perspective view of a plasma display panel.
Figure 2:
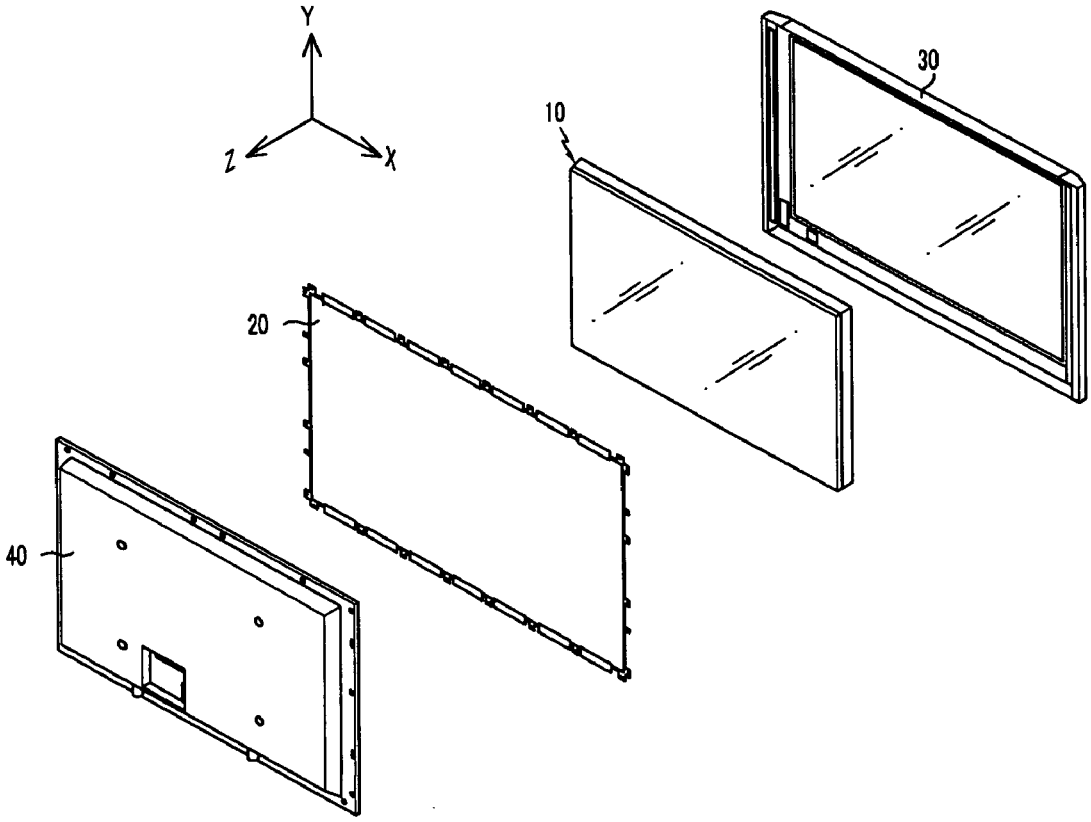
FIG. 2 is a simplified exploded perspective view of a plasma display apparatus in accordance with the present invention.

Referring to FIG. 2, a plasma display apparatus includes PDP 10, a chassis base 20, a front cover 30 and a back cover 40. The chassis base 20 is placed at a backside of the PDP 10 and attached thereto, the backside opposite to a side displaying an image. The front cover 30 is placed over the PDP 10, and the back cover 40 is placed over the chassis base 20. All of the components are assembled into a plasma display apparatus set.

Figure 3:
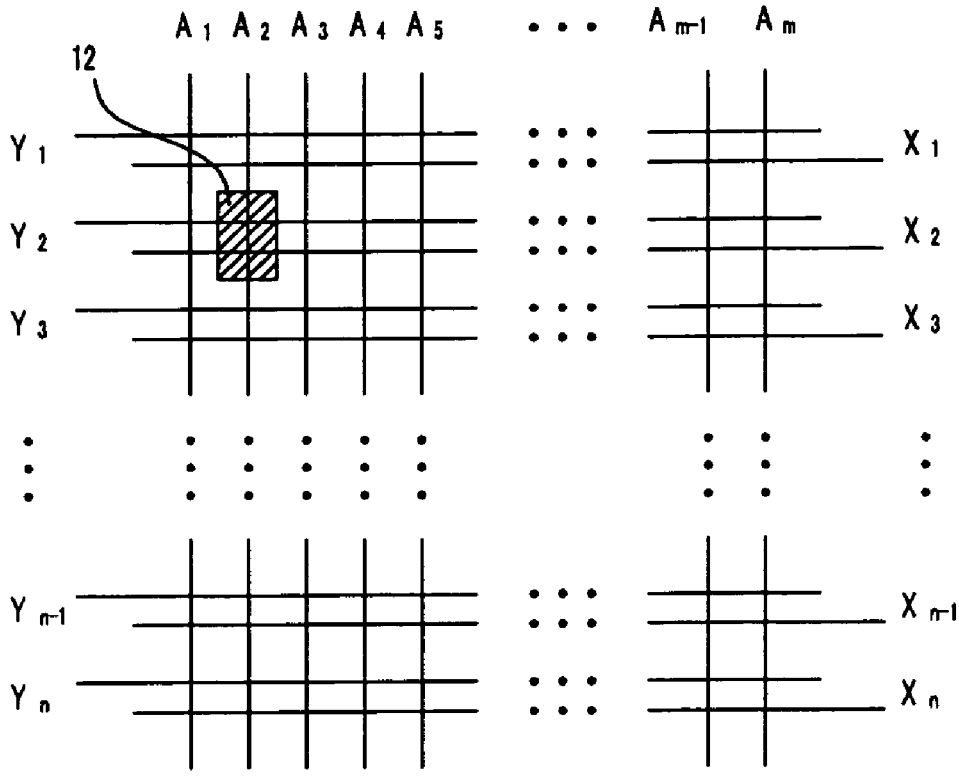
FIG. 3 is a schematic diagram of the plasma display panel in accordance with the present invention.

The PDP 10, as shown in FIG. 3, includes a plurality of first electrodes (sustain electrodes or X electrodes) X1–Xn extending in a row direction (of the drawing), a plurality of second electrodes (scan electrodes or Y electrodes) Y1–Yn extending in the row direction (of the drawing) and a plurality of third electrodes (address electrodes or A electrodes) A1–Am extending in a column direction (of the drawing). The sustain electrodes X1–Xn are formed corresponding to the respective scan electrodes Y1–Yn and generally have a common connection at one ends thereof. The PDP 10 includes a first substrate 1 having the sustain electrodes X1–Xn and the scan electrodes Y1–Yn arranged thereon and a second substrate 2 having the address electrodes A1–Am arranged thereon. The first substrate 1 and the second substrate 2 are positioned, apart from each other by discharge space 11, in such a way that the direction of the sustain electrodes X1–Xn and the scan electrodes Y1–Yn crosses in orthogonal that of the address electrodes A1–Am. Discharge cells 12 are formed in the discharge space 11 at intersections that the address electrodes A1–Am cross the sustain electrodes X1–Xn and the scan electrodes Y1–Yn.

Figure 4:
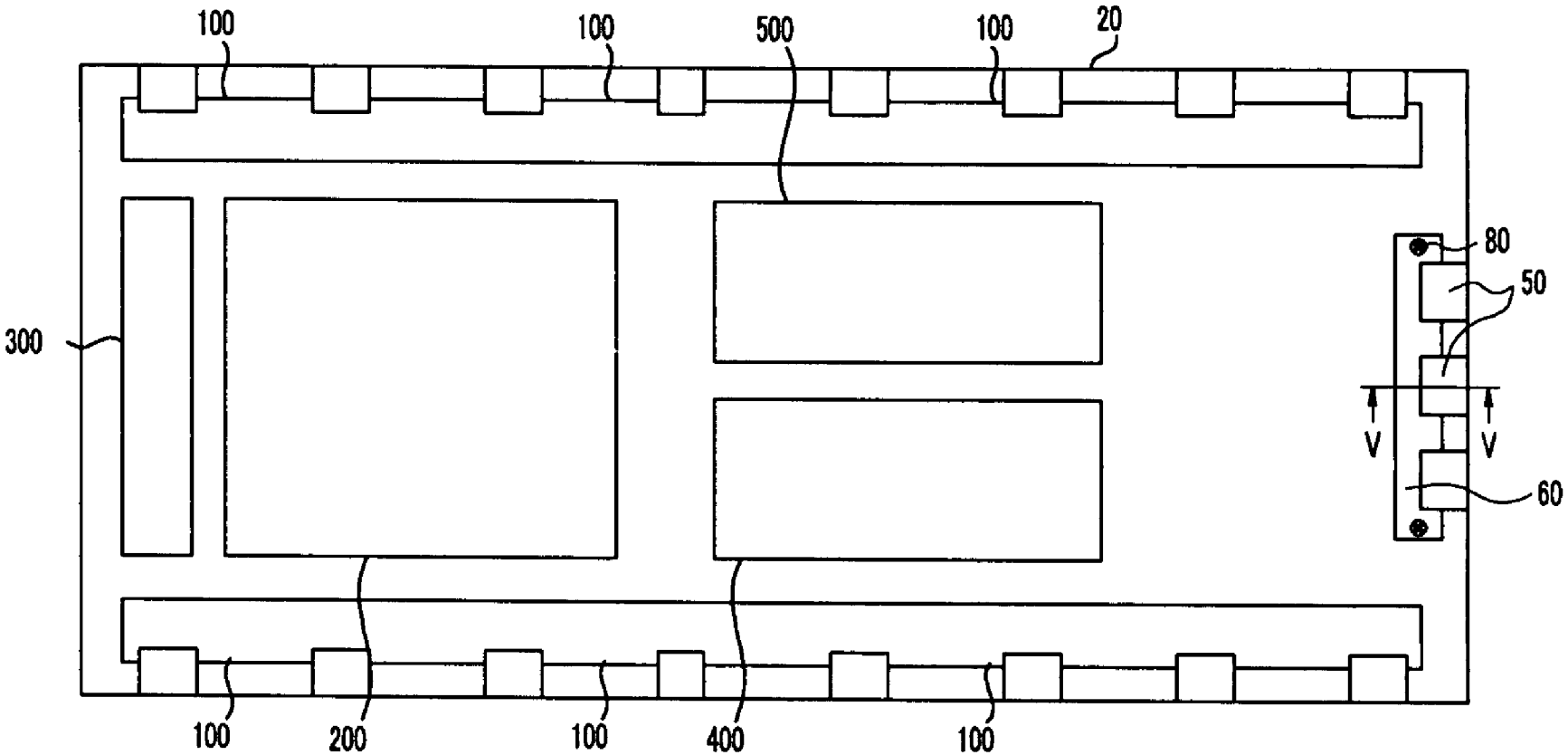
FIG. 4 is a schematic plan view of a chassis base in accordance with the present invention.

Referring to FIG. 4, the PDP 10 (not shown) is attached to one side of the chassis base 20 and supported thereby, and a plurality of driving boards 100, 200, 300, 400, 500 for driving the PDP 10 are installed on the other side of the chassis base 20.

An address buffer board 100 is formed respectively at an upper and a lower portions (of the drawing) in the chassis base 20. The address buffer board 100 may consist of a single board as shown in the drawing or plural boards (not shown). FIG. 4 exemplifies the plasma display apparatus with a dual driving for instance. In the case of a single driving, however, the address buffer board 100 is placed at either of the upper or the lower portions in the chassis base 20. The address buffer board 100 receives controlling signals for addressing from an image processing and controlling board 400 and applies a voltage to each address electrode A1–Am for selecting the discharge cell 12 to be displayed.

A scan driving board 200 is positioned in the left side (of the drawing) of the chassis base 20. The scan driving board 200 is electrically connected to the scan electrodes Y1–Yn via a scan buffer board 300. The sustain electrodes X1–Xn are biased to a predetermined voltage (0 V for example). The scan buffer board 300 applies a voltage to the scan electrode Y1–Yn for selecting the scan electrode Y1–Yn sequentially during the address period. The scan driving board 200 receives driving signals from the image processing and controlling board 400 and applies the driving voltage to the scan electrode Y1–Yn. FIG. 4 exemplifies both the scan driving board 200 and the scan buffer board 300 positioned in the left side of the chassis base 20. However, both may be positioned in the right side of the chassis base 20. Furthermore, the scan buffer board 300 may be integrated with the scan driving board 200.

The image processing and controlling board 400 receives image signals from outside, generates respective controlling signals to drive the address electrodes A1–Am and the scan electrodes Y1–Yn, and applies the respective controlling signals to the address buffer board 100 and the scan driving board 200.

A power supplying board 500 supplies power to drive the PDP 10. The image processing and controlling board 400 and the power supplying board 500 may be placed at the center of the chassis base 20.

Figure 5:
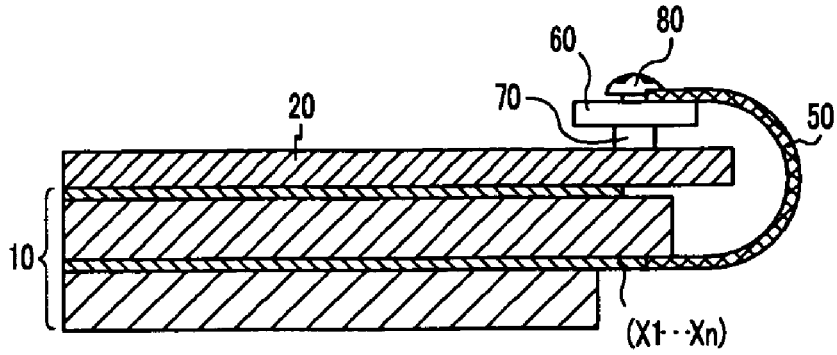
FIG. 5 is a cross-sectional view showing a plasma display panel and a chassis base in accordance with a first embodiment of the present invention taken along section line V—V of FIG. 4.
Figure 6:
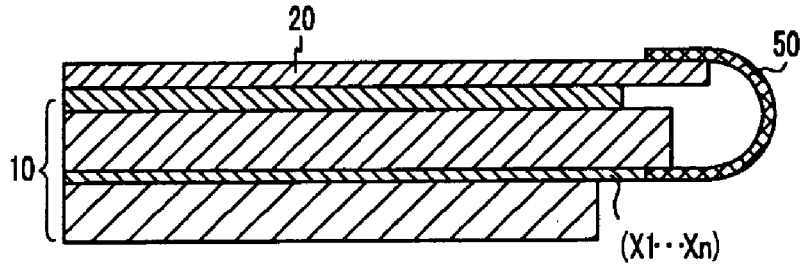
FIG. 6 is a cross-sectional view showing a plasma display panel and a chassis base in accordance with a second embodiment of the present invention

As shown in FIGS. 5 and 6, the sustain electrodes X1–Xn are grounded to the chassis base 20 through a flexible printed circuit (FPC) 50. In other words, the sustain electrodes X1–Xn formed inside the PDP 10 are extracted to the outside of the PDP 10 by means of the FPC 50.

The FPC 50 may be grounded to the chassis base through a grounding board 60, as shown in FIG. 5 or on the chassis base 20 directly, as shown in FIG. 6. In this case, the FPC 50 is not connected to an extra driving board but grounded directly on the chassis base 20.

The grounding board 60, as shown in FIG. 5, is fixed to a boss 70 on the chassis base 20 by a screw 80 and forms a grounding structure. Therefore, the FPC 50 is grounded to the chassis base 20 by means of the grounding board 60.

As aforementioned, the sustain electrodes X1–Xn are grounded to the chassis base 20, and the scan electrodes Y1–Yn are connected to the scan driving board 200 via the scan buffer board 300. The address electrodes A1–Am are connected to the address buffer board 100. And, both the scan buffer board 300 and the address buffer board 100 are connected to the image processing and controlling board 400 and operated by various controlling signals from the image processing and controlling board 400

To be more specific, the sustain electrodes X1–Xn can be grounded to the chassis base through the FPC 50 because a constant voltage, not a time-varying voltage, is applied to the sustain electrodes X1–Xn during the operation of the PDP 10 in the embodiments in accordance with the present invention. In other words, the sustain electrodes X1–Xn can be grounded to the chassis base by using the FPC 50 and the grounding board 60 because the sustain electrodes X1–Xn are biased to a reference voltage 0 V. Also, the sustain electrodes X1–Xn may be grounded to the chassis base 20 by connecting the FPC 50 directly to the chassis base 20.

With the sustain electrodes X1–Xn grounded to the chassis base 20, there is no need for any driving board to drive the sustain electrodes X1–Xn which reduces not only the occupying area of the driving boards 100–500 on the chassis base but also the total cost of the circuits necessary for driving the PDP 10.

When the ground voltage is applied to the sustain electrode and relatively a large voltage difference is applied to the scan electrode, the ground voltage applied to the sustain electrode may vary due to the variation in voltage applied to the scan electrode. In the case where the ground voltage applied to the sustain electrode is varied, the sustain discharge between the sustain electrode X1–Xn and the scan electrode Y1–Yn is affected. In addition, the sustain discharge may not occur even if a predetermined voltage is applied between the sustain electrode X1–Xn and the scan electrode Y1–Yn because the voltage to be applied otherwise between the sustain electrode X1–Xn and the scan electrode Y1–Yn is not applied therebetween. Therefore, the direct connection of the FPC 50 to the chassis base 20, as shown for the second embodiment, enlarges the grounding area where the FPC 50 is combined. As a result, the sustain electrode can be grounded with reliability and the variation in ground voltage can be prevented.

Figure 7:
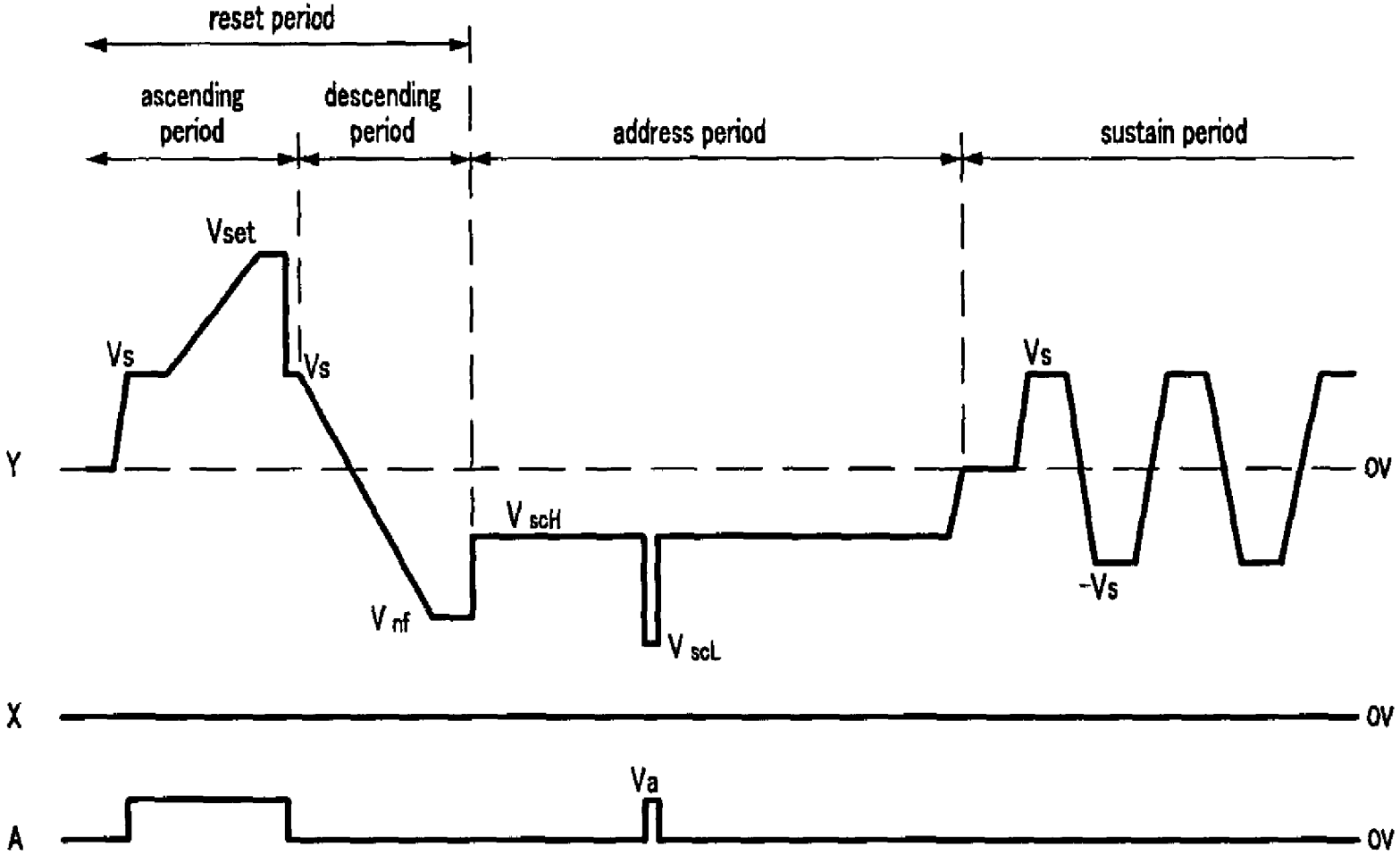
FIG. 7 is a graph showing driving waveforms for the plasma display panel in accordance with the present invention.

Hereinafter, explanations are given as to driving waveforms for the PDP 10 that are controlled by the driving boards 100–500. FIG. 7 shows driving waveforms for the plasma display panel in accordance with the present invention.

For convenience, respective driving waveforms applied to the X, Y, A electrodes of a single discharge cell are explained. In FIG. 7, the applied voltage to the Y electrode is supplied by the scan driving board 200 and the scan buffer board 300. And, the applied voltage to the A electrode is supplied by the address buffer board 100. The explanation about the voltage applied to the X electrode is omitted because the X electrode is biased to a reference voltage (the ground voltage 0 V in FIG. 7). The X electrode is grounded to the chassis base 20 through the FPC 50.

As shown in FIG. 7, one subfield consists of a reset period, an address period, and a sustain period. The reset period consists of an ascending period and a descending period.

In the ascending period of the reset period, while the voltage to the X electrode is maintained at a first voltage (a reference voltage, 0 V in FIG. 7), the voltage to the Y electrode rises gradually from a second voltage (Vs) to a third voltage (Vset). FIG. 7 exemplifies a rising voltage in a ramp type. When the voltage applied to the Y electrode rises, low intensity-discharge (weak discharge) occurs between the Y electrode and X electrode and between the Y electrode and A electrode. As a result, negative (–) wall charges are formed on the Y electrode and positive (+) wall charges are formed on the X and the A electrodes. Wall charge referred to in accordance with the present invention means charge formed near each electrode on the wall (for example, a dielectric layer) of the discharge cell. Though the wall charge is not in direct contact with the electrode surface, the wall charge is described by a term "formed", "accumulated" or "deposited" on the electrode. Also, the wall voltage means the difference in potential formed by the wall charge on the wall of the discharge cell.

In the case that the voltage to the Y electrode rises gradually as shown in FIG. 7, the weak discharge in the discharge cell 12 forms the wall charges in such a way that the sum of the wall voltage of the discharge cell 12 and the externally applied voltage is kept at a discharge firing voltage. U.S. Pat. No. 5,745,086 by Weber discloses such a principle. Since all the discharge cells should be set at an initialized state during the rest period, Vset is a voltage that is large enough to ignite discharge in all the discharge cells in various states. Also, Vs is a voltage that is usually higher than the applied voltage to Y electrode during the sustain period and lower than the discharge firing voltage applied between the X electrode and Y electrode.

In the descending period of the reset period, with the A electrode maintained at the reference voltage, the voltage to the Y electrode decreases gradually from a fourth voltage (Vs) to a fifth voltage (Vnf). Meanwhile, a weak discharge occurs between the Y electrode and X electrode and between the Y electrode and A electrode. Then, the negative (–) and the positive (+) wall charges previously formed on the Y electrode and on the X and the A electrodes respectively are erased. Generally, Vnf is set at a voltage around the discharge firing voltage. If so, the wall voltage between the X electrode and the Y electrode becomes almost to 0 V and can prevent the discharge cell where no address discharge occurred previously from misdischarging during the sustain period. Since the A electrode is maintained at the reference voltage, the wall voltage between the Y electrode and the A electrode is determined by the magnitude of Vnf.

Next, a scan pulse with a voltage VscL and an address pulse with an eighth voltage (Va) are applied to the Y electrode and the A electrode, respectively, to select the discharge cell 12 to be turned on in the address period. The non-selected Y electrode is biased to a voltage VscH higher than VscL, and the A electrode of the discharge cell 12 not to be turned on is provided with the reference voltage. In order to carry out such an operation, the scan buffer board 300 selects, from the Y electrodes Y1–Yn, one Y electrode to which the scan pulse of VscL is to be applied. For instance, in the single driving, the scan buffer board 300 may select a Y electrode in sequential order of the column direction. And, at the time when one Y electrode is selected, one A electrode that the address pulse of Va is to be applied to is selected by the address buffer board 100 from the A electrodes A1–Am corresponding to the discharge cells formed by the selected Y electrode.

Specifically, a scan pulse of VscL is first applied to the scan electrode (Y1 in FIG. 3) in the first row. At the same time, an address pulse of Va is applied to an A electrode that located in the discharge cell 12 to be turned on of the discharge cells in the first row. Then a discharge occurs between the Y electrode of the first row and the A electrode to which Va is applied. As a result, (+) wall charges are formed on the Y electrode, and (−) wall charges are formed on the A and the X electrodes. As a result, the wall voltage (Vwxy) between the X electrode and the Y electrode is formed in such a way that the potential on the Y electrode is higher than that on the X electrode. Secondly, an address pulse of Va is applied to an A electrode that located in the discharge cell 12 to be turned on of the discharge cells in the second row, while a scan pulse of VscL is applied to the scan electrode Y (Y2 in FIG. 3) in the second row. Then, an address discharge occurs between the Y electrode of the second row and the A electrode to which Va is applied, and wall charges are formed in the discharge cell 12, as aforementioned. While a scan pulse of VscL is applied sequentially to other Y electrodes in the remaining row, an address pulse of Va is applied to an A electrode in the discharge cell 12 to be turned on, and the wall charge are formed thereby.

In such an address period, the voltage VscL is generally set equal to or lower than the voltage Vnf. In addition, the voltage Va is set higher than the reference voltage. The reason of the address discharge by the voltage Va in the discharge cell 12 is explained in an exemplified case that the voltage VscL is equal to the voltage Vnf.

When the voltage Vnf is applied during the reset period, the sum of the wall voltage between the A electrode and the Y electrode and the external voltage (Vnf) between the A electrode and the Y electrode is determined by the discharge firing voltage (Vfay) between the A electrode and the Y electrode. However, the voltage Vfay is formed between the A electrode and the Y electrode when the reference voltage (0 V) and the voltage VscL(=Vnf) are applied to the A electrode and the Y electrode, respectively. This condition may cause a discharge. However, no discharge occurs, though, in general because the discharge delay time in this case is longer than the widths of the scan pulse and the address pulse. In the case that the voltages of Va and VscL(=Vnf) are applied, respectively, to the A electrode and the Y electrode, however, the voltage formed between the A electrode and the Y electrode is larger than Vfay. Therefore, the discharge can occur because the discharge delay time is shorter than the width of the scan pulse. In order to ignite the address discharge easily, the voltage VscL may be set lower than the voltage Vnf.

In the discharge cell 12 that the address discharge occurred previously in the address period, the wall voltage Vwxy of the Y electrode with respect to the X electrode is high. Therefore, the sustain discharge is ignited between the X electrode and the Y electrode during the sustain period by applying a pulse having a voltage Vs to the Y electrode first. The voltage Vs is set in the range that the voltage Vs is lower than the discharge firing voltage (Vfxy) between the X electrode and the Y electrode, and the voltage Vs+Vwxy is higher than Vfxy. By the sustain discharge, (−) wall charges are formed on the Y electrode, and (+) wall charges are formed on the X and the A electrodes. And the wall voltage Vwyx of the X electrode with respect to the Y electrode is high.

Next, because the wall voltage Vwyx of the X electrode with respect to the Y electrode is high, the sustain discharge is ignited between the X electrode and the Y electrode by applying a pulse having a voltage −Vs to the Y electrode. As a result, (+) wall charges are formed on the Y electrode, and (−) wall charges are formed on the X and the A electrodes. Accordingly, the sustain discharge becomes ready to occur under the condition that the voltage Vs is applied to the Y electrode. After that, applying the scan pulse of Vs to the scan electrode (Y) and applying the scan pulse of −Vs to the scan electrode are repeated by the number corresponding to the weighted factor that the relevant subfield displays.

In accordance with the present invention, as explained above, the reset operation, the address operation and the sustain discharge operation can be carried out by only a driving waveform applied to the Y electrode under the condition that the X electrode is biased to the reference voltage. Therefore, the driving board for the X electrode can be eliminated by simply biasing the X electrode to the reference voltage.

According to FIG. 7, the final voltage applied to the Y electrode in the descending period of the reset period is set at the voltage Vnf.

As explained earlier, the final voltage Vnf is set around the discharge firing voltage between the X electrode and the Y electrode. In general, the discharge firing voltage (Vfay) between the Y electrode and the A electrode is lower than the discharge firing voltage (Vfxy) between the Y electrode and the X electrode. Therefore, the potential on the Y electrode is higher due to the wall charge than that on the A electrode at the time when the final voltage (Vnf) is applied in the descending period. Therefore, the wall voltage on the Y electrode with respect to the A electrode may set to be positive. Since no sustain discharge occurs in the discharge cell where no address discharge was occurred previously, the reset period of the next subfield is carried out while maintaining the such a state of the wall charge. In the discharge cell 12 with this state, the wall voltage on the Y electrode with respect to the A electrode is greater than the wall voltage on the Y electrode with respect to the X electrode. As a result, in the ascending period of the reset period when the voltage to the Y electrode rises, the voltage between the A electrode and the Y electrode exceeds the discharge firing voltage (Vfay), and after a certain time, the voltage between the X electrode and the Y electrode exceeds the discharge firing voltage (Vfxy)

Since the high voltage is applied to the Y electrode in the ascending period of the reset period, the Y electrode serves as an anode, and the A and the X electrodes as a cathode. The discharge in the discharge cell 12 is determined by the amount of secondary electrons emitted from the cathode at the time that positive ions collide with the cathode. This is called a γ-process. In general, the A electrode of the PDP 10 is covered with a phosphor material to produce colors, and both the X electrode and the Y electrode are covered with a material having a high coefficient of secondary electron emission such as a MgO layer for an efficient sustain discharge. Although the voltage between the A electrode and the Y electrode exceeds the discharge firing voltage (Vfay) in the ascending period, the discharge between the A electrode and the Y electrode is delayed due to the A electrode, which is covered with the phosphor material and plays as a cathode. Due to the delay of the discharge, the voltage between the A electrode and the Y electrode is greater than the discharge firing voltage (Vfay) at the moment that the real discharge is ignited between the A electrode and the Y electrode. Such a high voltage may ignite a strong discharge between the A electrode and the Y electrode rather than a weak discharge therebetween. This strong discharge may cause a strong discharge between the X electrode and the Y electrode, and therefore, more wall charges are formed in the discharge cell than the wall charges formed in the normal ascending period. More priming particles may also be produced.

Figure 8:
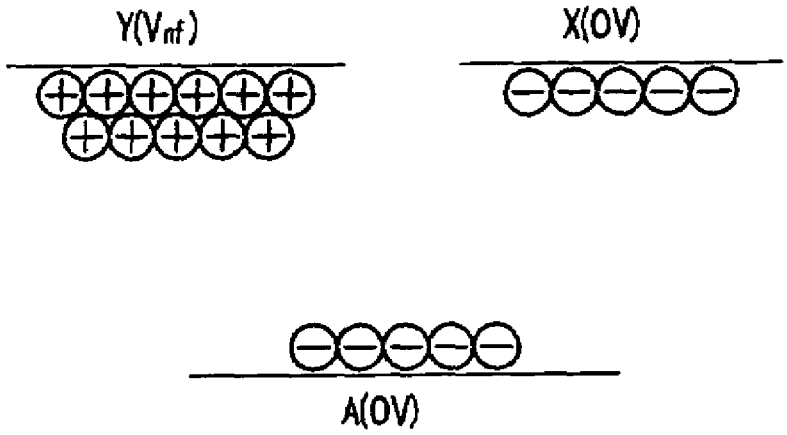
FIG. 8 is a schematic drawing showing the state of the wall charge in the discharge cell during the reset period.

If so, the large amount of the wall charges and the priming particles may cause a strong discharge in the descending period, and the wall charges formed between the X electrode and the Y electrode may not be eliminated completely, as shown in FIG. 8. The discharge cell 12 in this state forms a high wall voltage between the X electrode and the Y electrode after the end of the reset period. This high wall voltage may cause a misdischarge between the X electrode and the Y electrode in the sustain period even in the case that no address discharge occurred previously.

In the embodiments in accordance with the present invention, therefore, the voltage applied to the Y electrode rises from the voltage Vs to the voltage Vset gradually in the ascending period of the reset period with the A electrode kept biased to a predetermined voltage (greater than the reference voltage). Also, there is no need for an additional power source in the case that the biased voltage for the A electrode is set at Va as shown in FIG. 7. When the voltage to the Y electrode rises with the A electrode having a biased voltage Va, the voltage between the X electrode and the Y electrode exceeds the discharge firing voltage earlier than the voltage between the A electrode and the Y electrode does due to the small voltage between the A electrode and the Y electrode. Then, a weak discharge occurs first between the X electrode and the Y electrode, and the voltage between the A electrode and the Y electrode exceeds the discharge firing voltage with priming particles formed by this weak discharge. The priming particles reduce the delay time for the discharge between the A electrode and the Y electrode. Instead of the strong discharge occurred in the case mentioned earlier, the weak discharge is carried out to form the proper amount of the wall charges. Therefore, no strong discharge occurs in the descending period of the reset period so that misdischarge is prevented during the sustain period.

According to the present invention, the first electrode (the sustain electrode or the X electrode) is biased to a predetermined voltage (0 V), and the driving waveform is applied to only the second electrode (the scan electrode or the Y electrode). Therefore, the driving board to drive the first electrode can be eliminated by grounding the FPC in connection with the first electrode on the chassis base. This means that the driving boards are integrated into a single driving board substantially and that the cost is reduced thereby.

Also, the direct connection of the FPC to the chassis base may enlarge the grounding area where the FPC is attached. As a result, the sustain electrode can be grounded with reliability and the variation in ground voltage can be prevented.

Although exemplary embodiments in accordance with the present invention have been described in detail hereinabove, it should be understood that many variations and/or modifications of the basic inventive concept taught therein will still fall within the spirit and scope of the present invention, as defined in the appended claims.

What is claimed is:

1. A plasma display apparatus comprising:

a plasma display panel having a plurality of first electrodes, a plurality of second electrodes, and a plurality of third electrodes extending in a direction crossing the plurality of the first and the plurality of second electrodes;

a chassis base to which the plasma display panel is fixed; and driving boards attached on the chassis base, the driving boards generating a driving voltage and applying the driving voltage to the electrodes, wherein the first electrodes are grounded to the chassis base.

2. The plasma display apparatus of claim 1, wherein the chassis base has a first side and the driving boards are attached to a second side of the chassis base, the second side of the chassis base being opposite to the first side of the chassis base to which the plasma display panel is fixed.

3. The plasma display apparatus of claim 1, wherein the driving boards include:

an image processing and controlling board receiving image signals from outside and generating controlling signals to drive the third electrodes and controlling signals to drive the second electrodes;

an address buffer board receiving controlling signals from the image processing and controlling board and applying to the third electrodes a voltage to select the discharge cell to be displayed;

a scan driving board receiving driving signals from the image processing and controlling board and applying a driving voltage to the second electrodes; and a power supplying board supplying power to drive the plasma display panel.

4. The plasma display apparatus of claim 1, wherein the first electrodes are grounded to the chassis base through a flexible printed circuit.

5. The plasma display apparatus of claim 4, wherein the flexible printed circuit is grounded to the chassis base through a ground board grounded to the chassis base.

6. The plasma display apparatus of claim 4, wherein the flexible printed circuit is grounded directly to the chassis base.

7. A plasma display apparatus comprising:

a plasma display panel having a plurality of first electrodes; a plurality of second electrodes; and a plurality of third electrodes extending in a direction crossing the plurality of the first and the plurality of second electrodes;

a chassis base to which the plasma display panel is fixed; and driving boards attached to the chassis base, the driving boards generating a driving voltage and applying the driving voltage to the electrodes, wherein the driving boards include an image processing and controlling board receiving image signals from outside and generating controlling signals, wherein the image signals from outside include a plurality of frames, each frame being divided into plural subfields, and at least one subfield including a reset period, an address period and a sustain period, the reset period being when discharge cells are initialized, the address period being when a discharge cell to be turned on is selected, and the sustain period being when, with the first electrode biased to a first voltage, pulses having a second voltage and a third voltage lower than the second voltage alternatingly are applied to the second electrode to make a sustain discharge occur in the selected discharge cell, and wherein the first electrodes are grounded to the chassis base.

8. The plasma display apparatus of claim 7, wherein the chassis base has a first side and the driving boards are attached to a second side of the chassis base, the second side of the chassis base being opposite to the first side of the chassis base to which the plasma display panel is fixed.

9. The plasma display apparatus of claim 7, wherein a voltage applied to the second electrodes rises from a fourth voltage to a fifth voltage gradually and then falls from a sixth voltage to a seventh voltage gradually in the reset period, with the first electrodes biased to the first voltage, and wherein a voltage applied to the third electrodes in a first time period, the first time period being at least a part of the time period when the voltage to the second electrodes rises form the fourth voltage to the fifth voltage, is formed higher than an eighth voltage applied to the third electrodes during the time period when the voltage to the second electrodes falls to the seventh voltage.

10. The plasma display apparatus of claim 7, wherein a voltage difference between the second voltage and the first voltage is equal to the voltage difference between the first voltage and the third voltage.

11. The plasma display apparatus of claim 7, wherein the first electrode is grounded to the chassis base through a flexible printed circuit.

12. The plasma display apparatus of claim 11, wherein the flexible printed circuit is grounded to the chassis base through a ground board grounded at bosses on the chassis base by means of screws.

13. The plasma display apparatus of claim 11, wherein the flexible printed circuit is grounded directly on the chassis base.

14. A method of reducing occupying area of driving boards driving a plasma display panel having a plurality of first electrodes, a plurality of second electrodes, and a plurality of third electrodes extending in a direction crossing the plurality of the first and the second electrodes, and a chassis base to which the plasma display panel is fixed, the driving boards being attached on the chassis base and generating a driving voltage and applying the driving voltage to the electrodes, the method comprising grounding the first electrodes to the chassis base.

15. The method of claim 14, wherein a flexible printed circuit grounds the first electrodes to the chassis base.

16. The method of claim 15, wherein the flexible printed circuit is grounded to the chassis base through a ground board grounded to the chassis base.

17. The method of claim 15, wherein the flexible printed circuit is grounded directly to the chassis base.

* * * * *